United States Patent [19]

Beretta

[11] Patent Number: 4,916,843

[45] Date of Patent: Apr. 17, 1990

[54] SAFETY MEANS FOR THE BOLT OF AUTOMATIC AND SEMIAUTOMATIC PISTOLS

[75] Inventor: Pier G. Beretta, Gardone V.T., Italy

[73] Assignee: Fabrica D'Armi P. Beretta, S.p.A., Brescia, Italy

[21] Appl. No.: 244,932

[22] Filed: Sep. 15, 1988

[30] Foreign Application Priority Data

May 20, 1988 [IT] Italy ..... 5165-A/88

[51] Int. Cl.[4] ..... F41C 17/00

[52] U.S. Cl. ..... 42/70.01; 89/196

[58] Field of Search ..... 42/70.01; 89/163, 194, 89/195, 196, 197

[56] References Cited

U.S. PATENT DOCUMENTS 3,620,125 11/1971 Beretta .
3,657,959 4/1972 Kart .
4,127,056 11/1978 Kart .
4,681,020 7/1987 Polanecky .
4,742,634 5/1988 Swenson .

FOREIGN PATENT DOCUMENTS 10301 of 1895 United Kingdom .

*Primary Examiner*—Charles T. Jordan
*Assistant Examiner*—Richard W. Wendtland
*Attorney, Agent, or Firm*—McGlew & Tuttle

[57] ABSTRACT

Disclosed is a safety means for the bolt of semiautomatic and automatic pistols, which comprises, on at least one side of the bolt, a throat, complete with striking step and arresting element provided and coupled therewith, for the prevention of dangerous rearward projections of the bolt against the user, when the rear portion of the bolt has suffered a breakage due to improper or accidental causes.

5 Claims, 2 Drawing Sheets

SAFETY MEANS FOR THE BOLT OF AUTOMATIC AND SEMIAUTOMATIC PISTOLS

FIELD OF THE INVENTION

The present invention relates, in general, to semiautomatic and automatic pistols and, more particularly, to a safety means for arresting the bolt or obturator of these pistols in case of an emergency.

BACKGROUND OF THE INVENTION

Semiautomatic, as well as automatic pistols comprise usually a bolt or obturator which is guidedly capable of operational, longitudinal movements or displacements, back and forth along and on the body of the firearm. Further, the bolt or obturator is provided, usually on its front or anterior part, with an arresting or blocking portion which interacts with a fixed shoulder provided on the body itself, so as to limit the retro movement of the bolt. On the other hand, the forward movement of the bolt is limited by its support, when in the closed position.

Now, unexpected or accidental causes or reasons, such as the incorrect use of the pistol, the careless maintenance thereof, the employment of improper ammunition or of cartridges with excessive charge, etc. may be a source of cracks or faulty lines, which as time goes on result in the breaking of the bolt. The breakage may occur in areas of lesser resistance, such as those in the back of the arresting means which limit the retro movement of the bolt. In such a case, the normal arresting means provided on the bolt are insufficient to prevent that the rear portion thereof, no longer held, be violently projected rearwardly when the projectile that causes the final ultimate breakage of the bolt is fired, with the attendant danger to the user of the pistol. Hence, the need to provide this type of pistols with means which can prevent such an occurrence, in the event that the bolt be broken, and keep the user physical injury.

BRIEF DESCRIPTION OF THE INVENTION

It is therefore, the main object of the present invention to provide a safety means for pistols, which might block on the body of the firearm, preventing its retro movement, the rear portion of the bolt and, thusly, avoid that the cracked and broken element of the firearm be projected against the user.

This object of the invention is achieved with a safety means for semiautomatic, as well as automatic pistols of the type havig a guided and longitudinal sliding bolt supplied with means to define the retro movement of the bolt itself on the body of the firearm. This safety means comprises, at least on one side of the bolt, a longitudinal throat, interrupted so as to define a striking step faced toward the back of the bolt, and a fixed or stationary arresting element, attached directly or indirectly to the body of the firearm and coupled with the throat, without preventing the operational slidings of the bolt. This arresting element serves to intercept the striking step, so as to arrest or block on the body of the firearm, in case of accidental breakage of the bolt, that portion of the latter which, no longer held, would be projected rearwardly against the user. Advantageously, the stationary arresting element is attached to or is integral with a removable and interchangeable part, mounted on the body of the firearm, preferably to the pivot or pin bearing the hammer of the pistol. Specifically, such an arresting element may consist of a swelling or head, integral with the pivot or pin and coinciding with the throat of the bolt, in position of intercepting the striking step, when at least a portion of the bolt is moving rearwardly beyond the limit defined by the normal means provided for arresting the retro movement of the bolt. The device of the invention has the ability of being incorporated in pistols of new manufacture, as well as in already existing pistols, without particular problems or limitations and at reasonable cost. It is, thus, possible to regenerate firearms already in use and provide them with the instant safety means, without additional parts or changes, but simply by utilizing the existing or readily interchangeable parts of a pistol. In fact, the application of the safety means of the invention to pistols already in use affords simply the substitution of a portion of the pistol, such as the hammer's pin, which is interchangeable anyway, with an analogous one which is provided with an arresting element, and the installation of the throat and corresponding terminal striking step on the bolt.

In addition, in the event that a breakage of the bolt really occurs, since the body and the other portions of the pistol are not exposed to damage, the integrity of the weapon may be restored simply by a replacement of the bolt, with eventual prior substitution of the arresting element, in case the bolt is notched.

THE DRAWINGS

An example of a practical embodiment of the invention will be described in greater detail hereinbelow, with reference to the accompanying drawings, in which.

DETAILED DESCRIPTION OF THE INVENTION

Figure 1:
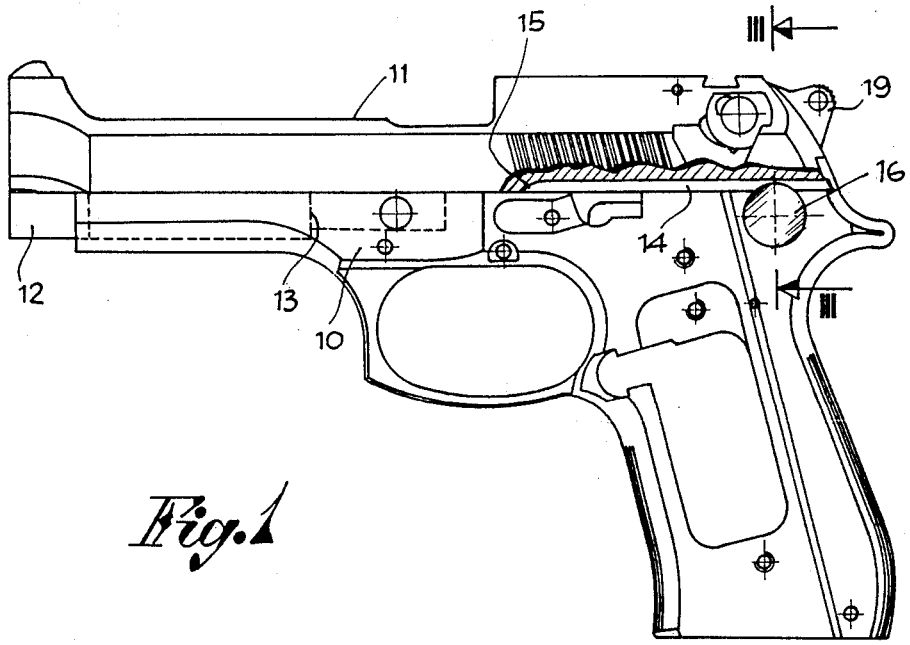
FIG. 1 is a schematic view of the body and bolt of a pistol, the bolt being in the forward, closed position.
Figure 2:
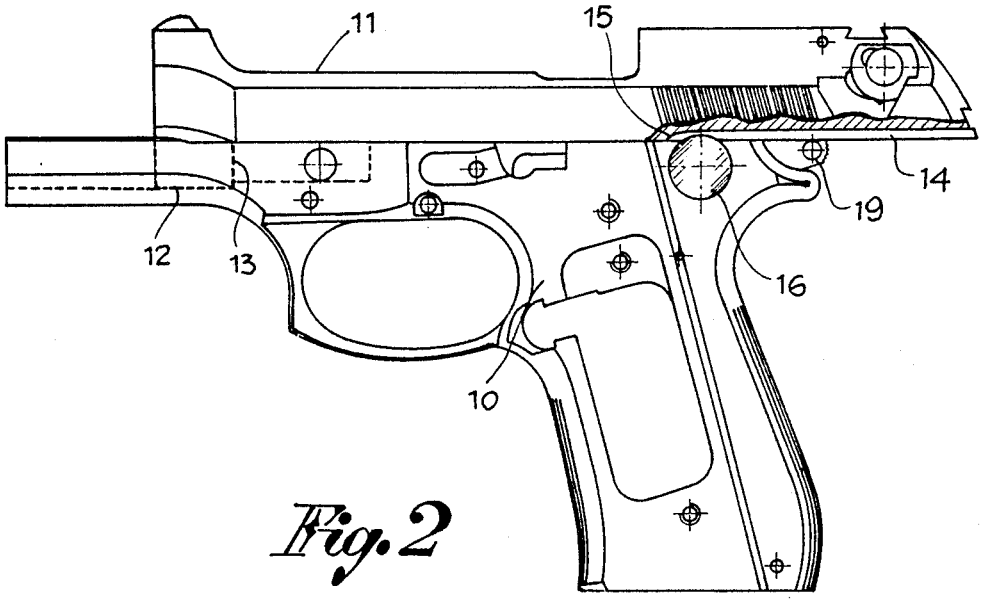
FIG. 2 is a view analogous to that of FIG. 1, but with the bolt in the retro, open position.
Figure 4:
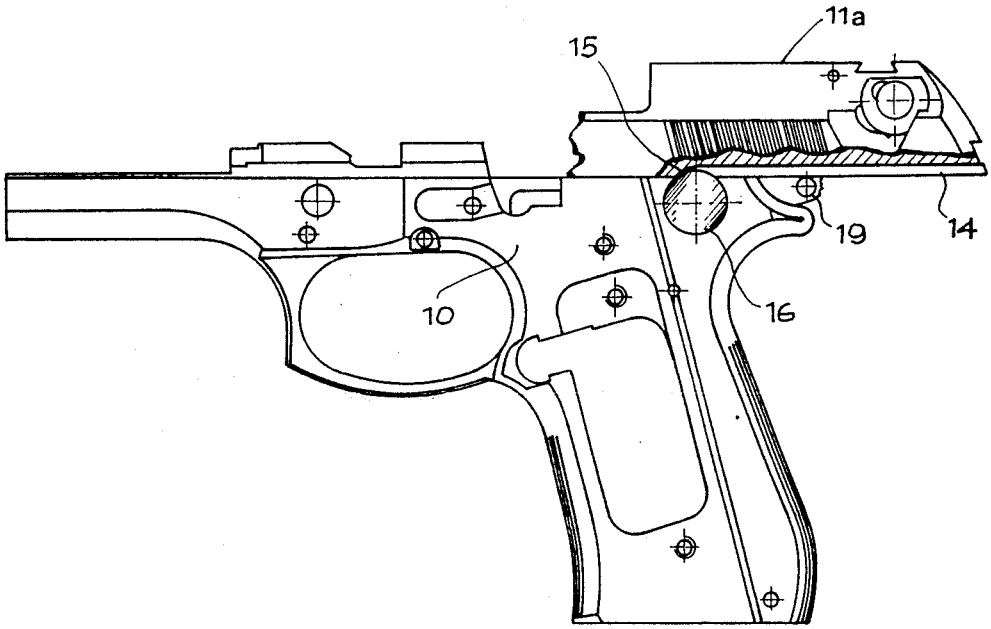
FIG. 4 is a view analogous to that of FIG. 2, but with the rear portion of the bolt broken in condition of blockage on the body of the firearm.
Figure 3:
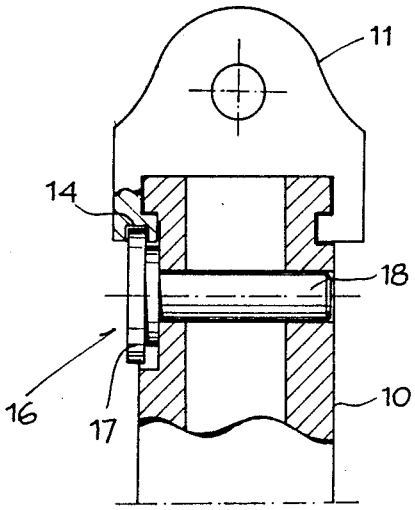
FIG. 3 is an enlarged, sectional view of the pistol, taken along arrows III—III of FIG. 1.

Referring now to the accompanying drawings, numeral 10 represents in general the body of the pistol and numeral 11 the bolt thereof, which is guided and movable longitudinally forward and back on the body 10 in manner known per se. The bolt 11 is provided, in its front part, with an arresting or blocking portion 12 which interacts—see FIG. 2—with a fixed shoulder 13 situated on an intermediate part of the body, so as to limit the retro movement of the bolt. The forward movement of the bolt is limited, instead, by its own support, when in the closed position, as shown in FIG. 1. In accordance with the invention, at least on one side of the bolt, there is provided a longitudinal throat 14 of limited length and, optionally, also open in the rear part of the bolt, but, in any event, closed toward the front of the bolt, so as to form a striking step 15 which faces toward the back. To the body 10, there is attached, directly or indirectly, a stationary arresting element 16, which interacts with the throat 14 and serves, in particular, to intercept the striking step 15. In the embodiment illustrated in the accompanying drawings, the arresting element 16 is formed by a swelling or head 17 which is either attached to or integral with a pivot or pin 18, mounted transversely on the body 10 and carrying the hammer 19 of the pistol—see FIG. 3. The head 17 coincides with the throat 14 of the stricking pin of the pistol and is at least partially at level height with the striking step 15. The length of the throat 14, or the position of the striking step 15 and, conversely, the arresting element 16, is such as not to interfere with the normal longitudinal displacements of the bolt 11—see FIGS. 1 and 2—defined, toward the rear, by the arresting portion 12 with the shoulder 13 and, toward the front, by the closing support of the bolt. If, however, for any reason whatever, the bolt is subject to breakage in back of the arresting portion 12—see FIG. 4—, the rear part 11*a* of the bolt, no longer held when propelled by the gas pressure resulting from a shell firing, is projected rearwardly beyond its normal limit. Then, the striking step 15 comes to rest against the arresting element 16, so as to keep safely the part 11*a* of the bolt attached to the body 10, preventing the projection toward the back against the user and achieving the safety purpose which is the object of this invention.

What is claimed is:

1. Pistol arrangement, comprising:

a pistol body including an upper bolt engaging portion with a fixed shoulder; a bolt connected to said pistol body for retromovement along the pistol body by propelling gases of a shell, said bolt including an arresting portion positioned adjacent a front end of said bolt, said arresting portion engaging said fixed shoulder, for limiting the retromovement of said bolt with respect to said pistol body; a longitudinal throat defined by said bolt, said longitudinal throat having a front end providing a striking step, said striking step facing toward a rear end of said bolt; and, a stationary arresting element, fixed to said pistol body, said stationary arresting element including a portion projecting into said throat for engaging said striking step to arrest said bolt with respect to said pistol body, in the event of breakage of said bolt and said portion projecting into said throat, not engaging said striking step during normal retromovement of said bolt along said pistol body.

2. Safety means according to claim 1, wherein said stationary arresting element is attached to or integral with a removable and interchangeable element mounted on the body of the pistol.

3. Safety means according to claim 2, wherein said removable and interchangeable element is a pivot or pin transversely mounted on the body of the pistol and carrying the hammer thereof, and wherein the stationary arresting element consists of a swelling or head which is integral with said pivot or pin and is placed in intercepting position with said striking step on the bolt.

4. Safety means according to claims 1, 2 or 3, wherein said throat is open at the rear of the bolt and is interrupted by said striking step at a place intermediate the length of the bolt.

5. A pistol arrangement, comprising a pistol body including an upper bolt engaging portion with a fixed shoulder; a bolt including an arresting portion adjacent a front end of said bolt, said arresting portion engaging said fixed shoulder upon retromovement of said bolt along the pistol body by propelling gases of a shell, for limiting the retromovement of said bolt with respect to said pistol body, said arresting portion being positioned spaced a distance from said fixed shoulder in a pre-firing state, said distance from said arresting portion to said fixed shoulder defining a retromovement distance; a longitudinal throat defined by said bolt, said longitudinal throat having a front end providing a striking step facing toward a rear end of the bolt; and, a stationary arresting element, fixed to said pistol body, said stationary arresting element including a portion projecting into said throat, said portion projecting into said throat being spaced from said striking step, in the pre-firing state, a distance which is greater than said retromovement distance, said portion projecting into said throat engaging said striking step to arrest said bolt with respect to said pistol body, in the event of breakage of said bolt.

* * * * *